US010792681B2

(12) United States Patent
Alves

(10) Patent No.: US 10,792,681 B2
(45) Date of Patent: Oct. 6, 2020

(54) NOZZLE FOR DISCHARGING COMPRESSED AIR

(71) Applicant: Ford Global Technologies, LLC, Dearborn, MI (US)

(72) Inventor: Bruno Alves, Huerth (DE)

(73) Assignee: Ford Global Technologies, LLC, Dearborn, MI (US)

( * ) Notice: Subject to any disclaimer, the term of this patent is extended or adjusted under 35 U.S.C. 154(b) by 165 days.

(21) Appl. No.: 15/888,610

(22) Filed: Feb. 5, 2018

(65) Prior Publication Data

US 2018/0229249 A1 Aug. 16, 2018

(30) Foreign Application Priority Data

Feb. 13, 2017 (DE) ..... 10 2017 202 258

(51) Int. Cl.

*B05B 1/34* (2006.01)
*B05B 1/00* (2006.01)
*B05B 7/08* (2006.01)

(52) U.S. Cl.

CPC ..... *B05B 1/3421* (2013.01); *B05B 1/005* (2013.01); *B05B 1/3405* (2013.01); *B05B 1/3431* (2013.01); *B05B 7/0815* (2013.01)

(58) Field of Classification Search

CPC ... B05B 1/3421; B05B 1/3405; B05B 1/3431; B05B 7/0815; B05B 1/005
USPC ..... 239/290, 296, 423, 424, 487, 525, 550, 239/566, 590, DIG. 21, DIG. 22
See application file for complete search history.

(56) References Cited

U.S. PATENT DOCUMENTS 2,917,244 A 12/1959 Gould
3,790,085 A 2/1974 Ayer
3,920,187 A * 11/1975 Willis ..... B05B 1/28 239/487
4,050,632 A * 9/1977 Wyse ..... B05B 1/005 239/DIG. 22
5,832,974 A 11/1998 Jou
6,745,948 B1 * 6/2004 Hidaka ..... B05B 7/0861 239/424

(Continued)

FOREIGN PATENT DOCUMENTS

DE 2135298 3/1973
DE 3736448 5/1989

(Continued)

OTHER PUBLICATIONS

Nex Flow Air Products Corp., Products page, available at URL https://www.nexflow.com/.

*Primary Examiner* — Steven J Ganey
(74) *Attorney, Agent, or Firm* — Burris Law, PLLC

(57) ABSTRACT

The present disclosure relates to a nozzle for discharging compressed air having a circumferential surface section which extends from a feed end to a discharge end and extends at least partially axially, and an end section produced in one piece, which extends radially inward from the circumferential surface section at the discharge end. In order to allow efficient and targeted compressed air discharge, the present disclosure envisages that a plurality of helical passages extend through the end section, each of which slopes in a tangential direction, at least in some section or sections, and into each of which a first discharge opening for compressed air opens.

19 Claims, 2 Drawing Sheets

(56) References Cited

U.S. PATENT DOCUMENTS

| | | | | |
|---|---|---|---|---|
| 8,636,232 | B2 * | 1/2014 | Metzger ..... | A62C 31/02<br>239/487 |
| 9,056,328 | B2 | 6/2015 | Giovannini | |
| 9,296,277 | B2 | 3/2016 | Burr et al. | |
| 2010/0034604 | A1 | 2/2010 | Imamura et al. | |
| 2015/0366424 | A1 | 12/2015 | Naka et al. | |
| 2016/0075309 | A1 | 3/2016 | Ooe | |

FOREIGN PATENT DOCUMENTS

| | | |
|---|---|---|
| DE | 10336379 | 3/2005 |
| WO | 1981/001669 | 6/1981 |

* cited by examiner

NOZZLE FOR DISCHARGING COMPRESSED AIR

CROSS-REFERENCE TO RELATED APPLICATIONS

This application claims priority to and the benefit of German Application No. 102017202258.2 filed on Feb. 13, 2017. The disclosure of the above application is incorporated herein by reference.

FIELD

The present disclosure relates to a nozzle for discharging compressed air.

BACKGROUND

The statements in this section merely provide background information related to the present disclosure and may not constitute prior art.

In various industrial processes, there is a need to cool a workpiece or a device for producing or processing a workpiece. Such cooling may be necessary, for example, because a process step taking place in parallel or in advance can only be carried out at an elevated temperature or because production necessarily has to be carried out at this temperature, e.g. by means of friction. Various primary forming methods are likewise associated with heating. During injection molding, for example, a thermoplastic material is injected into the mold at elevated temperature. The primary forming of components made of rubber is also carried out at elevated temperature in order to permit or accelerate vulcanization. Particularly those parts of the mold which form the cavity that imparts a shape must therefore normally be continuously or repeatedly cooled.

Insofar as the corresponding mold is composed of metal, effective cooling can be accomplished by passing a cooling liquid (normally water) through passages within the mold. By virtue of the good thermal conductivity of metals, effective overall cooling of the mold is achieved through cooling in the region of the passages, which is primarily only local. In recent times, however, increasing use has been made of "hybrid tooling" in the primary forming sector, where the part of the mold which actually imparts the shape is formed by an insert inserted into a frame. Here, the concept envisages that one and the same frame can be used with different inserts. For reasons of cost and time saving, the insert is in this case often produced from plastic in a 3-D printing process. The frame may be cast from synthetic resin, but a metal frame can also be used.

In each case, at least that part of the mold which forms the cavity is composed of a material of poor thermal conductivity, which is normally about two powers of 10 below that of steel. Liquid cooling, such as that in the case of a metal mold, is therefore inefficient. However, direct cooling of the mold and, in particular, of the insert can be carried out by means of air. In this case, compressed air is discharged through one or more nozzles, and the air flow produced in this way is directed at the part to be cooled. In principle, heat transfer can be increased by increasing the speed of the inflowing air. This, in turn, is achieved by increasing the pressure, although that is expensive.

U.S. Pat. No. 9,056,328 B2 discloses a compressed air gun having a nozzle, which is screwed to a cylinder-like sleeve. Arranged next to the nozzle within the sleeve is a vortex generator, which has a cylindrical body and a plurality of in each case helically twisted walls arranged therein. The shape of the walls is intended to swirl an air flow that is being passed to the nozzle.

U.S. Patent Publication No. 2015/0366424 A1 discloses an end piece for a blower apparatus, such as a leaf blower, in which a plurality of guide surfaces is arranged within an external tube. Here, the guide surfaces can, in particular, extend helically. An inner tube can optionally be provided on the inside of the guide surfaces, wherein an overall air flow flows within the inner tube, on the one hand, and between the inner and outer tubes, on the other hand. The outer air flow is swirled by virtue of the alignment of the guide surfaces.

U.S. Patent Publication No. 2010/0034604 A1 discloses a device for cleaning machined holes by means of compressed air. Here, a nozzle is arranged within an outer jacket, which is placed around the machined hole, and can be inserted into the machined hole. The nozzle is formed by a tube, the end section of which is divided into three segments, which are twisted relative to one another and interconnected. Here, lateral openings and a central end opening for compressed air are provided between the segments. Owing to the twisting of the individual segments, an emerging air flow is swirled, thereby allowing chips to be blown out of the machined hole more effectively.

U.S. Pat. No. 9,296,277 B2 discloses an outlet device for a ventilation system of a motor vehicle, in which the air flow is divided into a first partial flow within a central passage and a second partial flow within an outer passage. Arranged within the outer passage is a plurality of helical guide walls, and the air flow is thereby deflected circumferentially there. By means of a kind of valve, different components of the air flow can be fed to the first or the second partial flow.

DE 103 36 379 A1 shows a suction nozzle, e.g. for a ventilation system of a motor vehicle, having a suction tube and a flow passage, wherein the flow passage has a constriction in the region of one end of the suction tube. Here, it is envisaged that the flow passage is of curved or arcuate design, with the result that a swirl is imparted to the air passed through it, this in turn leading to an increased speed of flow and an improvement in the suction effect.

DE 37 36 448 A1 discloses an air swirl outlet for blowing feed air into a room, e.g. for an air-conditioning system. Here, at least two mutually coaxial rings of pivotable swirl blades are arranged coaxially within an air guide passage. Respective partial flows with an individually adjustable swirl can thereby be produced by each ring.

U.S. Pat. No. 5,832,974 A discloses an air-blow gun having a clamping assembly, which contains a main holder, a clamp, a compensating sleeve and an air scavenge pipe. Here, the clamp, which is designed as a sleeve, is connected to the main holder by a thread. The compensating sleeve, which is screwed onto the clamp, has a tapered bore in order to force clamping strips in the direction of the center and thereby firmly clamp the air scavenge pipe. In the released state, the air scavenge pipe can be moved within the compensating sleeve and has a bent end region.

U.S. Patent Publication No. 2016/0075309 A1 shows an air blowing device, e.g. for supplying air in the region of the windshield of a vehicle, having an inlet passage, from which there branch off, in the form of a T, two side portions, in each of which helically extending guide walls are arranged. Here, the direction of rotation of the guide walls in the two side portions is opposed. Outlets, through which the air is blown out substantially tangentially transversely to the direction of extent of the side portions, are provided on the side portions.

In view of the indicated prior art, the provision of an efficient and targeted discharge of compressed air, especially for the air cooling of an object, still leaves room for improvement. In particular, it would be desirable to achieve effective air cooling at as low an air pressure as possible.

SUMMARY

The present disclosure provides an efficient and targeted discharge of compressed air.

It should be noted that features and measures presented individually in the following description can be combined in any technically feasible way and give rise to further forms of the present disclosure. The description additionally characterizes and specifies the present disclosure, especially in conjunction with the figures.

By means of the present disclosure, a nozzle for discharging compressed air is made available. This means that, when the nozzle is connected to a suitable compressed air feed, it blows out the compressed air or discharges it outward in a targeted manner, typically in the form of an air flow. Of course, the nozzle can also be used to discharge other pressurized gases. It is also conceivable for a gas/liquid mixture, for example, to be discharged by the nozzle. However, the nozzle according to the present disclosure is primarily intended for use with compressed air. Thus, where the term "compressed air" is used below, this also always implies possible use of other gases or of gas/liquid mixtures. In particular, the nozzle can form part of a manufacturing device, wherein it is used to produce a cooling air flow. However, it is also possible additionally to envisage the nozzle being used as part of a conventional air-blow gun.

The nozzle has a circumferential surface section which extends from a feed end to a discharge end and extends at least partially axially. Here, the feed end is the end from which the compressed air feed to the nozzle is provided, while the discharge end is the end at which the compressed air is discharged or expelled. Here, the axial direction can correspond, in particular, to a central axis or an axis of symmetry of the nozzle. In general, this defines a reference system with an axial, tangential and radial direction. Typically, the circumferential surface section extends in the axial direction over its entire length, even if it is conceivable that it deviates from this course in a direction toward the feed end, for example. However, at least an axial course in the direction of the discharge end is provided. Here, the circumferential surface section forms a shell-type outer wall of the nozzle, at least in some section or sections. In particular, it can be in the form of the circumferential surface of a cylinder or can be tubular, although a prismatic or prism-like design would also be conceivable. Normally, it is of closed design between the feed end and the discharge end in a radial direction (i.e. laterally), with the result that no compressed air can escape there. The circumferential surface section can have various structures for engagement with a tool or some other component, e.g. an external hexagon, an internal thread or an external thread.

The nozzle furthermore has an end section produced in one piece, which extends radially inward from the circumferential surface section at the discharge end. The end section is arranged at the discharge end and adjoins the circumferential surface section. It is generally connected rigidly to said section, e.g. nonpositively or materially. The end section can be not only produced in one piece in itself but can also be in one piece with the circumferential surface section. All the parts of the nozzle can be manufactured from metal. For production in this case, it is possible, in particular, to use an additive manufacturing method such as selective laser melting (SLM), selective electron beam melting (SEBM) or selective laser sintering (SLS). By means of these methods it is possible to build up three-dimensional bodies of virtually any shape by applying metal powder in layers and selectively fusing or sintering it. The radiation acting on the metal powder for this purpose is controlled in accordance with predetermined data (e.g. CAM data) of the object to be produced. The end section extends radially inward from the circumferential surface section and forms, as it were, an end face of the nozzle, while the circumferential surface section forms the circumferential surface, as mentioned.

According to the present disclosure, a plurality of helical passages extends through the end section, each of which slopes in a tangential direction, at least in some section or sections, and into each of which a first discharge opening for compressed air opens. Since each helical passage opens into a respective first discharge opening, a plurality of first discharge openings is thus provided. Each of these is an opening through which compressed air is discharged or expelled outward from the interior of the nozzle. In other words, each first discharge opening forms the outlet of a respective helical passage. The respective helical passage passes through the end section, i.e. from an opening remote from the discharge end, which can be referred to as an inlet opening, to the respective first discharge opening. Of course, the helical passage extends in the axial direction here but slopes in a tangential direction at least in some section or sections. In other words, when defining the respective direction of extent of the helical passage, said passage has an axial and a tangential component. This includes the possibility that there is additionally a slope in a radial direction. The helical passage may sometimes run in a straight line, although it has the slope described. Thus, the designation "helical passage" should not be interpreted restrictively. Normally, however, each helical passage extends in a helical shape, at least in some section or sections and, in one form, completely, i.e. in accordance with a helix or helical line. A helical line of this kind can extend at a constant radial distance from the central axis. The tangential slope can be constant or variable along the respective helical passage.

In order to enhance air guidance within the end section, the individual helical passages are, in one form, separated from one another, i.e. there is no connection between the individual passages within the end section. At the same time, the cross section of each of the helical passages can have a similar dimension in each direction, thereby enabling air friction to be reduced for a certain cross-sectional area. In particular, the cross section can be similar to a circle (e.g. elliptical) or circular in design. In respect of the number of helical passages, there are various possibilities, although at least 4, at least 6 or at least 8 helical passages are provided.

Owing to the presence of the helical passages, the air flow emerging through said passages has a tangential, that is to say to a certain extent circumferential, velocity component and, by virtue of the interaction between the air flows from the individual helical passages, there is turbulent swirling, by means of which the heat can be dissipated in a considerably more effective way from an object to be cooled when the air flow is directed at said object. It is significant here that the air flow is not swirled in an arbitrarily turbulent manner, which could disadvantageously reduce its range and controllability; instead, suitable arrangement of the helical passages means that it is still possible to direct the air flow selectively at particular regions of an object. It has also been found that there can even be cooperative effects between the individual air flows, with the result that the air flow may even accelerate after emerging from discharge openings instead of becoming slower. This makes it possible to achieve effective cooling, even when using a relatively low air pressure. The pressure reduction which is thus possible leads to a considerable cost saving.

In one form, the helical passages are arranged offset tangentially relative to one another. That is to say that the helical passages are offset by a certain angle relative to one another in relation to the central axis. It is possible here, in particular, for the individual helical passages to be of the same design. They can be arranged symmetrically in relation to the central axis, i.e. at the same radial distance from the latter and at uniform angular intervals relative to one another. It is self-evident that slight deviations from the symmetry described or from the uniformity of the design of the helical passages does not generally lead to any significant changes in the flow behavior.

According to one form, the end section has a plurality of axial passages offset tangentially relative to one another radially on the outside of the helical passages, wherein each axial passage opens into a respective second discharge opening for compressed air. That is to say that, in this arrangement, the helical passages are situated on the inside and the axial passages are situated on the outside in relation to the central axis. Accordingly, the first discharge openings are situated radially on the inside and the second discharge openings are situated radially on the outside. While the helical passages slope tangentially, as described, and, in particular, can be of helical design, the axial passages are of straight design. Moreover, they extend parallel to the axial-radial plane, wherein, in particular, they can extend parallel to the axial direction. Thus, the portion of the compressed air which flows through the axial passages and is discharged from the second discharge openings (which could be referred to as the outer partial flow) undergoes no tangential acceleration overall and thus does not contribute to the swirling of the overall air flow or not to the same extent as the air flow which flows out of the first discharge openings (which could be referred to as the inner partial flow). There can be various effects here, e.g. that the outer partial flow contributes to constricting, as it were focusing, the overall air flow. In addition, it can also happen that the outer partial flow is taken along by the inner partial flow and likewise undergoes a tangential acceleration.

The cross section of the axial passages can also have a similar transverse dimension in all directions, that is to say, in particular, can be similar to a circle or circular. The axial passages can be arranged symmetrically in relation to the central axis and thus at equal angular intervals relative to one another. All the axial passages can have the same dimensions. In respect of the number, there are, in principle, no restrictions, although, in particular, at least eight, at least ten or at least twelve axial passages can be provided. Here, the second discharge openings can be arranged in an axially recessed region of the end section. Such a recessed region is set back in the axial direction in the direction of the feed end relative to adjoining regions. In particular, the axially recessed region can be designed to run around tangentially, i.e. to be of ring-shaped design, in the manner of an annular depression or channel.

To form the desired flow profile outside the nozzle, it is desired that the end section is of closed design radially on the inside of the helical passages. In other words, the helical passages form the innermost openings within the end section. In a region situated radially further in, i.e. toward the central axis, there are no further openings, and it could also be stated that the end section is solid there. In this case, the helical passages can be arranged symmetrically around this closed central region.

In respect of the region of the nozzle which is ahead of the end section in the flow direction, various forms are conceivable. According to one form, the end section is adjoined in the direction of the feed end by a guide passage for guiding compressed air, which is designed to run at least most of the way around tangentially, in particular which can be designed to run all the way around, within the circumferential surface section. The guide passage serves to guide the compressed air from the feed end to the end section and thus to the helical passages and, where present, to the axial passages. In the process, it extends at least most of the way around in the tangential direction and, in particular, can be designed to run all the way around. It is also desired that the guide passage is designed symmetrically in relation to the central axis in order to allow likewise symmetrical inflow of the air to the end section.

In another form, an axially extending central section connected to the end section is formed radially on the inside of the guide passage. In this case, the central axis can pass through the central section. The cross section of the central section can be symmetrical with respect to the central axis and, in particular, can be circular. In this case, this cross section can increase in the region of the transition to the end section. The central section can extend axially from the end section at least over the majority of the length of the circumferential surface section. By means of the central section, the air flow can be deflected away from the central axis even before it reaches the end section, this being advantageous particularly if, as described above, the end section is of closed design radially on the inside of the helical passages. The central section is connected in one piece to the end section, which can be readily achieved as part of an additive manufacturing process. The central section can be self-supporting relative to the circumferential surface section, and is therefore connected only indirectly to the circumferential surface section via the end section.

In an advantageous development of the present disclosure, the first discharge openings are arranged radially on the outside of an axially extending projection of the end section. Here, the end section is normally of closed design radially on the inside of the helical passages, as described above. The axial projection is arranged in this closed region and therefore projects in the axial direction beyond the region having the first discharge openings. A projection of this kind can be used, for example, to shield the air flows from the individual first discharge openings from one another immediately after they emerge, and this has a positive effect on the flow behavior in some circumstances. The projection can be of symmetrical, in particular circular-symmetrical, design in relation to the central axis. In particular, the projection can be of conical design, i.e. of cone-type design, wherein the tip thereof can be rounded.

The guidance of the emerging air flow can furthermore be improved if each helical passage merges into a helically extending depression on an outer side of the projection. In this form, said depression forms, as it were, an extension of the respective helical passage, although, in contrast to the helical passage, it does not completely surround the air flow, but does so only partially, in particular radially on the inside.

On the inside, the circumferential surface section can be of simple cylindrical design, for example. However, further structuring of the inside is also possible. According to one form, the circumferential surface section has a plurality of axially extending grooves on the inside in the region of the guide passage. Grooves of this kind can extend over at least half of the axial length of the circumferential surface section, and optionally even more. In this case, the grooves can end before the end section or can optionally also be extended as far as the end section. Overall, they can serve to align the air flow within the guide passage and optionally also to guide it toward the axial passages. For this purpose, it is possible, in particular, for each groove to be aligned with an axial passage.

In this case, it is furthermore possible for a rib, which projects radially inward along the axial direction, to be formed between two grooves. By virtue of the axial course of the grooves, the corresponding rib also, of course, extends axially. Such ribs assist the guidance and/or division of the air flow. By virtue of the fact that the rib projects radially inward, there is a local constriction in the cross section of the circumferential surface section here. There are various possibilities as regards the shaping of the rib. In particular, the rib can project inward in a convex, i.e. arched, manner.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 2:
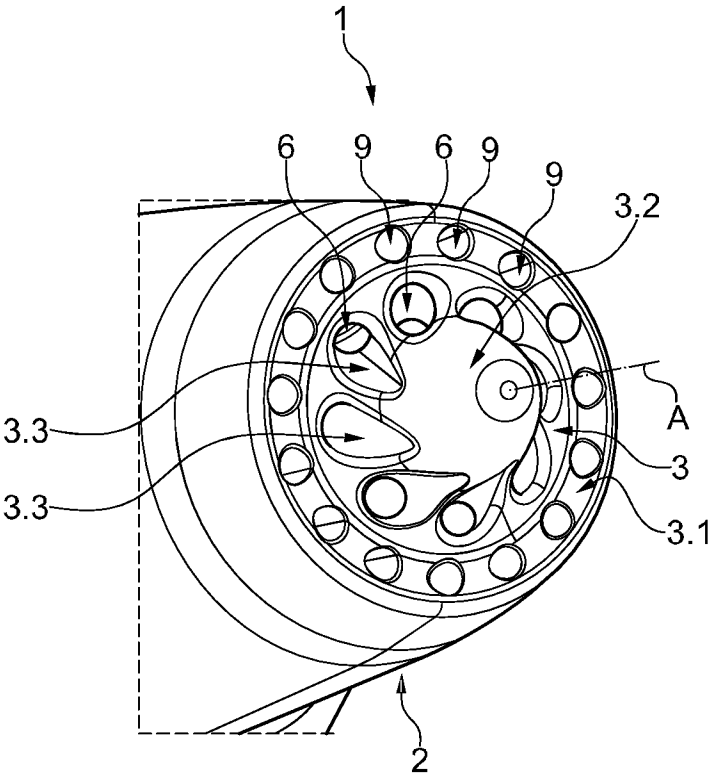
FIG. 2 shows a perspective illustration of a part of the nozzle from FIG. 1.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 1:
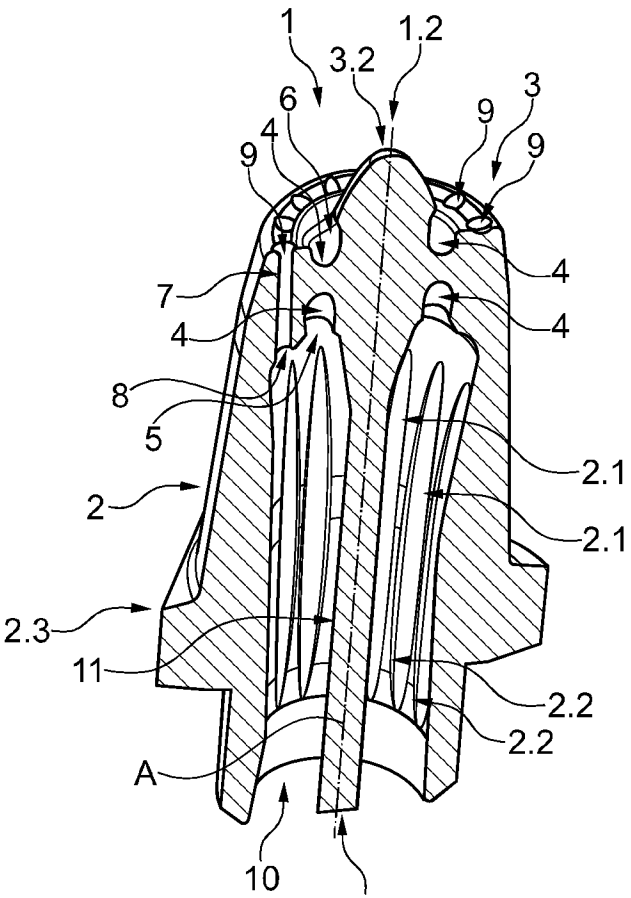
FIG. 1 shows a perspective cross-sectional view of a nozzle according to the present disclosure.

FIGS. 1 and 2 show a nozzle 1 according to the present disclosure for blowing out compressed air, wherein FIG. 1 shows a perspective cross-sectional view of the entire nozzle 1 and FIG. 2 shows a perspective illustration of part of the nozzle 1. The nozzle 1 shown is composed completely of metal and is produced in one piece by selective laser melting (SLM). The nozzle 1 has a circumferential surface section 2 roughly in the form of the circumferential surface of a cylinder, which is formed symmetrically in relation to a central axis A. The central axis A is used to define an axial, a radial and a tangential direction. The circumferential surface section 2 extends axially from a feed end 1.1 of the nozzle 1 to a discharge end 1.2. At the feed end 1.1, the nozzle can be connected to a compressed air feed, for which purpose the circumferential surface section 2 can have an external thread (not shown here), and the compressed air can be expelled at the discharge end 1.2. An external hexagon 2.3, which is provided for engagement with a wrench, is formed on an outer side of the circumferential surface section 2.

At the discharge end 1.2, as it were on the end of the circumferential surface section 2, an end section 3 extends radially inward. Together with the end section 3, the circumferential surface section 2 very largely surrounds a guide passage 10, through which the compressed air is passed from the feed end 1.1 to the end section 3. A series of passages 4, 7 for the targeted discharge of the compressed air is formed within the end section. A plurality of helical passages 4 is arranged symmetrically around the central axis A. In the present case, there are eight helical passages, although this should be taken only as an example. Each helical passage 4 extends in the axial direction through the end section 3, namely from a first inlet opening 5, which adjoins the guide passage 10, to a first discharge opening 6 on the outside of the end section 3. Here, the course of each helical passage 4 is in the form of a helix or helical line, which implies that it does not extend axially but slopes in the tangential direction. The helical passages 4 and thus also the first discharge openings 6 are arranged at the same radial distance from the central axis A and are each offset tangentially relative to one another by the same angle (namely 40°). To reduce the air friction within the helical passages 4, they have a circular (or slightly elliptical) cross section.

Radially on the inside of the helical passages 4, the end section is of closed design and has a conical axial projection 3.2. This serves to guide the air flows emerging from the helical passages 4 and keeps them separate from one another immediately after emergence. In this case, helically extending depressions 3.3 are formed on the outside of the projection 3.2. Each helical passage 4 merges into one of the eight depressions 3.3, so that each depression 3.3 guides the emerging air flow, as it were supplementing the action of the helical passage 4.

Formed radially on the outside of the helical passages 4 is a plurality of axial passages 7, which extend axially through the end section 3. In this case, each axial passage 7 extends from a second inlet opening 8 to a second discharge opening 9. Here, the second discharge openings 9 are arranged within an annular depression 3.1 in the end section 3. In contrast to the helical passages 4, the axial passages 7 do not slope in a tangential direction. In the present case, fifteen axial passages 7 are provided, although this should be understood only by way of example. In this arrangement, the cross section of the axial passages 7 is circular or slightly elliptical.

Radially on the inside of the first inlet opening 5, the end section 3 merges into a central section 11 within the guide passage 10. In this case, the central section 11 is of circular-symmetrical and column-type design and extends in a self-supporting manner along the entire length of the circumferential surface section 2. In the region of transition to the end section 3, the central section 11 is widened in the manner of a truncated cone. The function of the central section is essentially to guide the air flow on the way from the feed end 1.1 to the end section 3 away from the central axis A and thus approximately toward the first and second inlet openings 5, 8. Likewise serving to guide the air flow within the guide passage 10 is a plurality of axially extending grooves 2.1, which extend along the inside of the circumferential surface section 2 to just before the end section 3. An axially extending rib 2.2 is formed between each pair of grooves 2.1. Along the axial direction, each rib 2.2 arches convexly inward. In the present case, each groove 2.1 is in alignment with an axial passage 7, thereby assisting division and guidance of components of the air flow toward the axial passages 7.

During operation, the nozzle 1 is connected to a compressed air feed, resulting in an air flow through the guide passage 10, the helical passages 4 and the axial passages 7. While the air flow emerges substantially in an axial direction from the second discharge openings 9 of the axial passages 7, the air flow emerges from the first discharge openings 6 of the helical passages 4 with a tangential velocity component, resulting in an air flow resembling a helical line in interaction with the helical passages 4. This air flow interacts with the air flow emerging from the axial passages 7, which can contribute to constriction or focusing of the air flow. Overall, it has been found that the air flow is constricted radially with increasing distance from the end section 3, that is to say is as it were focused, wherein the speed thereof increases. Relatively high speeds can therefore be achieved at a certain distance from the nozzle 1, even if the air pressure at the feed end 1.1 is only moderate. At the same time, the movement resembling a helical line within the air flow provides turbulence, which, in interaction with the high speed of flow, provides that the air flow is well-suited to cooling an object.

Figure 3:
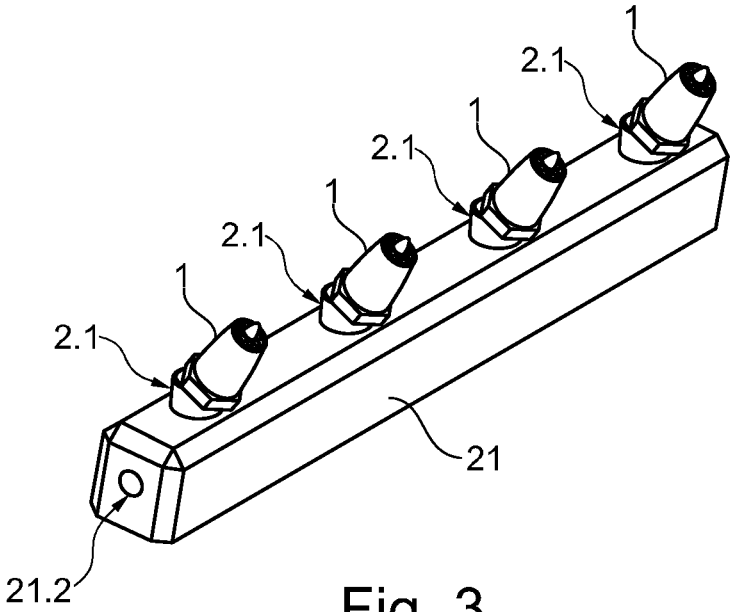
FIG. 3 shows a perspective illustration of a compressed air distributor having a plurality of nozzles in accordance with FIG. 1.
Figure 4:
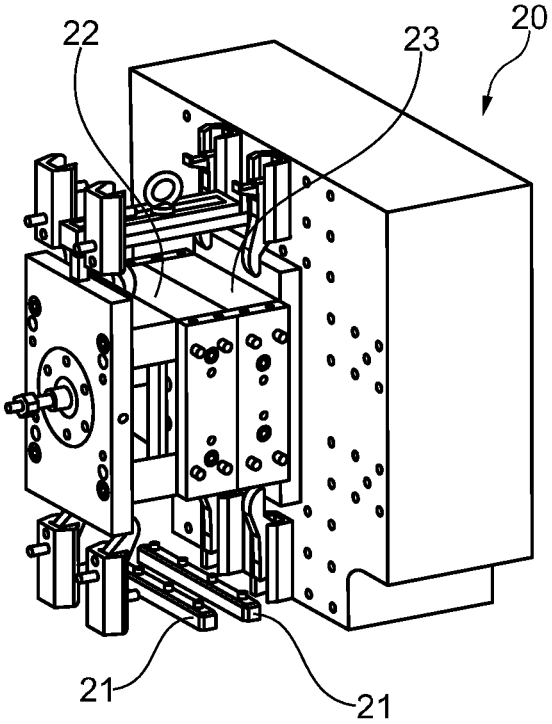
FIG. 4 shows a perspective illustration of a device having two compressed air distributors in accordance with FIG. 3.

An illustrative use of the nozzle 1 is illustrated in FIGS. 3 and 4. In this case, FIG. 3 shows a compressed air distributor 21, having four discharge connections 21.1, to each of which a nozzle 1 is connected. At the side, the compressed air distributor 21 has a feed connection 21.2, which is connected to a compressed air source. As illustrated in FIG. 4, two such compressed air distributors 21 can be used as parts of a device 20 for the primary forming of a component. The exact construction of the device 20 is not relevant here and, to this extent, is not explained in detail. Inter alia, it has two mold halves 22, 23, which each have a frame and an insert inserted therein. Here, the frame is cast from synthetic resin and the insert is produced from plastic in a 3-D printing process. Since both said materials have relatively poor thermal conductivity, liquid cooling of the mold halves 22, 23 would not be effective. Instead, a cooling air flow is directed at the mold halves 22, 23 by means of the compressed air distributors 21 and of the nozzles 1 according to the present disclosure (not shown in FIG. 4), the air flow being distinguished by good heat transfer and thus a good cooling effect, even at a relatively low air pressure, by virtue of the flow profile described above.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A nozzle for discharging compressed air comprising:

a circumferential surface section extending at least partially axially from a feed end to a discharge end; and an end section extending radially inward from the circumferential surface section at the discharge end, wherein a plurality of helical passages extend through the end section and at least one each helical passage slopes in a tangential direction, wherein each helical passage forms a first discharge opening for compressed air and the end section is adjoined in a direction toward the feed end by a guide passage for guiding compressed air, the guide passage extending tangentially within the circumferential surface section.

2. The nozzle as claimed in claim 1, wherein the end section is one piece.

3. The nozzle as claimed in claim 1, wherein the plurality of helical passages are arranged offset tangentially relative to one another.

4. The nozzle as claimed in claim 1, wherein the end section includes a plurality of axial passages offset tangentially relative to one another radially outside of the plurality helical passages, wherein each axial passage opens into a respective second discharge opening for compressed air.

5. The nozzle as claimed in claim 1, wherein the end section is closed radially on an inside of the plurality of helical passages.

6. The nozzle as claimed in claim 1, wherein an axially extending central section connected to the end section is formed radially inside the guide passage.

7. The nozzle as claimed in claim 1, wherein the first discharge opening of each helical passage is arranged radially outside of an axially extending projection of the end section.

8. The nozzle as claimed in claim 7, wherein each helical passage merges into a helically extending depression on an outer side of the projection.

9. The nozzle as claimed in claim 1, wherein the circumferential surface section includes a plurality of axially extending grooves on an inside region of a guide passage.

10. The nozzle as claimed in claim 9, wherein a rib that projects radially inward along an axial direction is formed between two grooves.

11. A nozzle comprising:

a circumferential surface section extending between a feed end to a discharge end;

an end section extending radially inward from the circumferential surface section at the discharge end and having a closed central region;

a plurality of helical passages extending through the end section and arranged symmetrically around the closed central region of the end section, each helical passage forming a first discharge opening and sloping in a tangential direction; and a plurality of axial passages extending through the end section, each axial passage forming a second discharge opening.

12. The nozzle as claimed in claim 11, wherein a portion of the circumferential surface section defines an external hexagon geometry.

13. The nozzle as claimed in claim 11 further comprising a guide passage having a central section extending along a length of the circumferential surface section, wherein the central section merges with the end section.

14. The nozzle as claimed in claim 13, wherein a region where the central section merges with the end section widens such that a truncated cone is formed.

15. The nozzle as claimed in claim 11 further comprising a guide passage and at least one pair of axially extending grooves extending along an inside region of the circumferential surface section.

16. The nozzle as claimed in claim 15, wherein an axially extending rib is formed between each pair of axially extending grooves, each rib convexly arching inward.

17. The nozzle as claimed in claim 11, wherein the first discharge opening of each helical passage is arranged radially outside of an axially extending projection arranged in the closed central region of the end section.

18. The nozzle as claimed in claim 17, wherein each helical passage merges into a helically extending depression formed on the projection.

19. The nozzle as claimed in claim 11, wherein the second discharge opening of each axial passage is circular or elliptical and merges into an annular depression.

* * * * *